US007708083B2

(12) United States Patent
Dresig et al.

(10) Patent No.: US 7,708,083 B2
(45) Date of Patent: May 4, 2010

(54) HAND POWER TOOL WITH A PERCUSSION MERCHANISM, AND AS A METHOD OF OPERATING THE HAND POWER TOOL

(75) Inventors: Friedmar Dresig, Chemnitz (DE); Joachim Hecht, Magstadt (DE)

(73) Assignee: Robert Bosch GmbH, Stuttgart (DE)

( * ) Notice: Subject to any disclaimer, the term of this patent is extended or adjusted under 35 U.S.C. 154(b) by 1244 days.

(21) Appl. No.: 10/958,432

(22) Filed: Oct. 5, 2004

(65) Prior Publication Data

US 2005/0072584 A1 Apr. 7, 2005

(30) Foreign Application Priority Data

Oct. 7, 2003 (DE) ..... 103 46 534

(51) Int. Cl.
*B25D 9/06* (2006.01)

(52) U.S. Cl. ..... 173/2; 173/48; 173/176; 173/201

(58) Field of Classification Search ..... 173/1, 173/2, 176, 183, 48, 109, 201; 81/467, 469
See application file for complete search history.

(56) References Cited

U.S. PATENT DOCUMENTS 3,828,865 A * 8/1974 Schnizler, Jr. ..... 173/48
4,669,551 A * 6/1987 Lippacher et al. ..... 173/109
5,159,986 A * 11/1992 Hoser ..... 173/48
5,203,242 A * 4/1993 Hansson ..... 81/469
5,361,852 A * 11/1994 Inoue et al. ..... 173/176
5,581,042 A * 12/1996 Tambini ..... 73/862.21
6,076,616 A * 6/2000 Kramp et al. ..... 173/162.2
6,138,772 A 10/2000 Miescher et al.
6,390,205 B2 * 5/2002 Wallgren et al. ..... 173/2
6,516,896 B1 * 2/2003 Bookshar et al. ..... 173/1
6,520,266 B2 * 2/2003 Bongers-Ambrosius et al. .. 173/2
6,539,603 B1 * 4/2003 Bulow ..... 29/407.01
6,799,643 B2 * 10/2004 Voulkidis et al. ..... 173/170
2002/0056558 A1 5/2002 Bongers-Ambrosius et al.
2004/0226728 A1 11/2004 Boeni et al.

FOREIGN PATENT DOCUMENTS

DE 101 42 569 A1 3/2003
EP 1 452 278 A1 9/2004
EP 1 502 710 A1 2/2005

* cited by examiner

*Primary Examiner*—Scott A. Smith
(74) *Attorney, Agent, or Firm*—Michael J. Striker

(57) ABSTRACT

A hand power tool has a percussion mechanism; a drive motor that drives the percussion mechanism; a conversion element for converting a movement of the drive motor into an axial movement; and an operating unit that adjusts a rotary movement of the conversion element within a percussion period depending on at least one optimization criterium.

6 Claims, 2 Drawing Sheets

HAND POWER TOOL WITH A PERCUSSION MERCHANISM, AND AS A METHOD OF OPERATING THE HAND POWER TOOL

BACKGROUND OF THE INVENTION

The present invention relates to a hand power tool with a percussion mechanism, and to a method of operating the hand power tool.

A percussion hammer is known, in which an electric motor is arranged in a housing and drives a conversion element of a pneumatic percussion mechanism through a drive shaft. The conversion element converts a motor rotary movement into an axial movement and has a crank drive, on which a piston rod is turnably supported on an eccentrically supported pin. The piston rod is connected with a piston turnably on a side facing away from the crank drive. Through the piston rod, the piston is displaceably supported in a percussion mechanism tube and is movable with a sine-shaped path-time course, and a striker displaceably supported in the percussion mechanism tube is drivable with the piston through a gas cushion.

German patent document DE 101 42 569 A1 discloses a conversion element, wherein a pin is guided on a material cam track of a rotatably driving cam element with a relative movement with respect to the cam element. A rigid sine-shaped path-time course of a piston movement can be avoided, and a cam course of the cam path can be determined in a purposeful manner with respect to the transmission means and its properties.

SUMMARY OF THE INVENTION

Accordingly, it is an object of the present invention to provide a hand power tool with a percussion mechanism which is drivable by a driver motor and has a conversion element which converts a motor rotary movement into an axial movement, and avoids the disadvantages of the prior art.

In accordance with the present invention it is proposed to provide an operating unit, with which a rotary movement of the conversion element within a percussion period is adjustable in a purposeful manner, depending on at least one optimization criterium.

The conversion element causes an axial movement of a body, for example a piston or a spindle, which is in direct operative connection with the conversion element. Thereby from a rigid sine-shaped path-time course, for example of the piston of a crank shaft operated as a conversion element, deviations can be made, to realize when needed one or more optimization purposes within a permission period. The percussion periods, in particular, depending on a transmission ratio, can include several revolutions of the drive motor. In a pneumatic percussion mechanism a part of these percussion period corresponds to a compression phase. In a mechanical percussion mechanism, the percussion periods correspond to a time between two strikes.

A periodic process for the path-time course of the conversion element can be provided when each percussion period is performed in the same way as the preceding percussions periods, also when the rotary movements of the drive motor are varied within a percussion period. Optionally, successive percussion periods can be changed however also individually. An optimization criteria can be for example an axial movement course of the conversion element which is optimal for the drilling progress, an optimal percussion speed, a low drive moment and the like. Thus, the conventional pressure course with high pressure peaks in a compression chamber can be replaced with a course which is favorable for the drilling progress or comfort. A mechanical loading of the compression chamber is reduced, and the drive energy can be used efficiently for uniform pressure buildup. With a small drive moment and a small material loading, especially advantageous acceleration of the striker can be achieved. With a transmission medium formed as a gas cushion between the piston and the striker, unnecessarily high pressure peaks can be avoided, and a percussion mechanism tube which surrounds a compression chamber can be made with a thinner wall thickness. The weight of the percussion mechanism is reducible and the comfort of the hand power tool can be increased.

Preferably, a motor rotary speed can be changed so that the axial movement of a body which is in direct operative connection with the conversion element has a path-time course which deviates from a sine form. Thereby undesirable pressure peaks in a compression chamber of a pneumatic percussion mechanism can be avoided. The hand power tool is operatable more comfortably and usable more efficiently.

Preferably, at least a part of the operation unit can be formed by a control unit which controls the drive motor. Optionally, a regulating unit can be provided for regulation of the drive motor. The rotary speed of the drive motor can be changed within a percussion period including several revolutions, from one revolution to another. The control unit or regulating unit has for example a storage means which contains the previously calculated axial movement courses of the conversion element, substantially desired axial path-time courses of a piston or an arresting disc, which depending on one or several optimization criteria and/or operational conditions can be adjusted, depending on used tool types, tool diameters, materials to be machined, etc.

The conversion element can be guided within a percussion period in a purposeful fashion along a predetermined path-time course. The conversion element is no longer rotated uniformly, but the rotation is performed non uniformly in a purposeful fashion. Thereby, an axial movement course is provided which is followed finally by the tool. The tool can perform a percussion or a rotary-percussion movement. Advantageously, the power pickup of the hand power tool is performed uniformly. In particular vibration tendency of the network-dependent operating hand power tool can be significantly reduced.

When the operating unit in accordance with the present invention includes means for adjusting a speed of the conversion element depending on a demand, an optimization of the drilling process within a percussion period can be provided by a predetermined speed course. For example over wide regions of the percussion period, a high speed of the striker can be adjusted. Preferably, with the pneumatic percussion mechanism a high speed is adjustable with a pressure which is as low as possible.

When the operating unit in accordance with the present invention includes means for adjusting a pressure of a compression chamber depending on a demand, a substantially freely selectable course can be adjusted. This can be performed by a path-time course of a piston of a crank drive which is changeable in a purposeful fashion. An undesirable high pressure load of the compression chamber by pressure peaks can be avoided.

When the operating unit in accordance with the present invention includes means for adjusting a drive moment depending on a demand, then a drive moment which is favorable for the drilling progress, in particular a minimal drive moment, can be adjusted in a purposeful fashion.

When the conversion element in accordance with the present invention includes a crank drive, a movement of striker can be influenced in a purposeful fashion via the axial movement of an associated piston.

When the conversion element in accordance with the present invention includes a locking disc pair, the relative movement of two locking discs can be influenced in a purposeful fashion. It is further proposed to adjust a rotary movement of a conversion element for conversion of a motor movement into an axial movement within a percussion period, depending on at least one optimization criterium.

When a motor rotary varied in accordance with the present invention within a percussion period including several motor revolutions, when in a very simple manner the path-time course of a crank drive or a locking disc pair can be varied depending on an optimization criterium. The percussion periods can include several motor revolutions. A path-time course of a piston can be adjusted depending on the demand. Thereby, the pressure peaks, for example in a compression chamber of a pneumatic percussion mechanism, can be avoided and correspondingly an operational behavior for different boundary conditions is presented in an optimal fashion. The efficiency of the hand power tool can be increased.

When the axial movement of the conversion element is calculated in accordance with the present invention depending on an optimization criterium and the motor movement is adjusted after the calculation, a reliable optimized handling of the hand power tool is possible. A recalculation for example of a piston movement of a crank drive or a drilling spindle connected with a locking percussion mechanism on a drive provides in a simple manner the required, predetermined motor movement. It can be correspondingly electronically controlled, for performing the calculated movement course within a percussion period. When several successive percussion periods are performed one after the other in this way, advantageously a periodical process is carried out. With a mechanical percussion mechanism the sliding of the locking discs of a locking percussion mechanism on one another is guided correspondingly.

Optionally the axial movement of a striker can be calculated depending on an optimization criterium and the motor movement is adjusted after the calculation. The striker is in operative connection with a piston indirectly through a transmission medium, while it is directly driven by the conversion element. Thereby an influence of a transmission medium which transmits the axial movements of the conversion element to the striker or a corresponding transmission means transmitting the percussion energy to the tool, can be taken into consideration.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
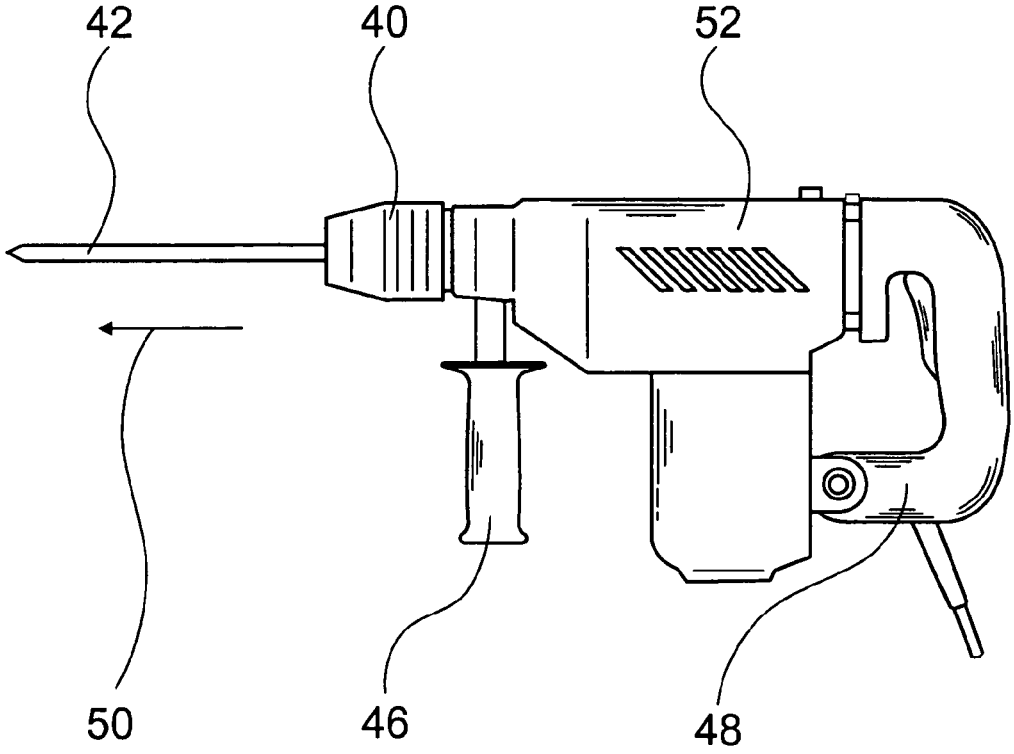
FIG. 1 is a view schematically showing a percussion hammer.

FIG. 1 schematically shows a percussion hammer with a housing and a not shown drive motor accommodated in the housing. The permission hammer has a tool holder 40 which holds a tool 42. As seen opposite to an operating direction 50, a first handle 46 is located after the tool holder 40 and mounted on the housing 22 transversely to the operating direction 50. At the side of the housing 22 which faces away from the tool holder 40, a second bracket-shaped handle 48 is arranged and extends transversely to the operating direction 50.

A percussion mechanism for a preferable hand power tool, which is drivable by a drive motor 10, is shown as a pneumatic percussion mechanism and illustrated in FIGS. 2-5. The hand power tool is preferably a hammer drill, a percussion hammer or a chisel hammer, a breaking hammer, or a percussion drilling power tool.

Figure 2:
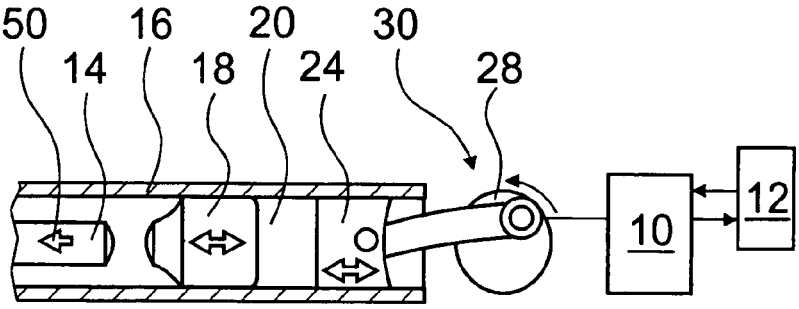
FIG. 2 is a view schematically showing a preferable pneumatic percussion mechanism with a flying piston in accordance with the present invention.
Figure 3:
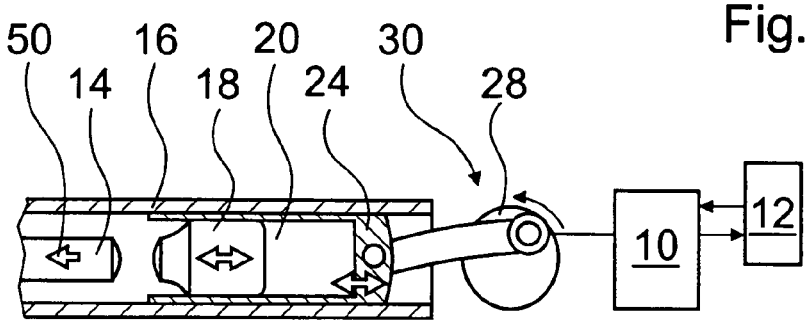
FIG. 3 is a view schematically showing a preferable pneumatic percussion mechanism with a flying piston and a piston cylinder in accordance with the present invention.
Figure 4:
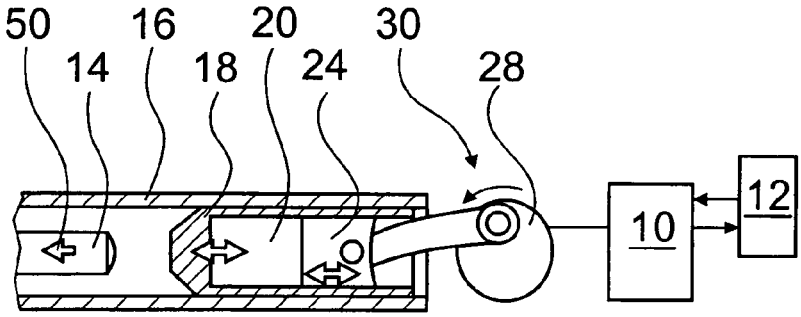
FIG. 4 is a view schematically showing a preferable pneumatic percussion mechanism with a percussion cup in accordance with the present invention.

In FIGS. 2-4 a flying piston is provided to form a striker 18 for accelerating a plunger 14 to a not shown tool, while in FIG. 3 a percussion cup forms the striker 18. The striker 18 represents a transmission means for transmitting the percussion energy of a conversion element 30 to the tool 42. Substantially the same components are identified basically with the same reference numerals. The drive motor 10 is connected with an operating unit 12, for example a control unit or a regulating unit, and is controllable or regulatable by it.

The drive motor 10 drives the conversion element 30 whose rotary movement is transmitted through a rod to a piston 24 in a percussion mechanism tube 16 and converted into an axial movement. The conversion element 30 is formed here by a crank drive 28 with an eccentric. Basically also other mechanisms can be used which are known for persons skilled in the art. An axial movement of the piston 24 is transmittable via a transmission medium in a compression chamber 22 to a striker 18, and the striker 18 strikes against the plunger 14 which acts on a not shown tool. The transmission medium is conventionally a gas cushion, for example composed of air. It is to be understood that other spring elements or spring systems known to a person skilled in the art can be used as transmission media.

In accordance with the present invention the rotary movement of the conversion element 30 is changeable in a targeted (purposeful) fashion, whereby the axial path-time course of the piston 24 is influenciable. Preferably this is performed by a change of the rotary movement of the drive motor 10 or a drive shaft of the drive motor 10 by the operating unit 12. The movement of the conversion element 30 is dependent directly on the drive motor 10 and a transmission which conventionally is connected with it and not shown in the drawings. The transmission converts the rotary speed of the motor into a conventionally lower rotary speed of the conversion element 30. With a typical conversion ratio 7:1, a motor rotary speed of for example 21000 revolutions per minute is converted into 3000 revolutions per minute of the conversion element 30.

The drive motor 10 rotates, in correspondence with the transmission ratio seven times during a compression phase, while the individual strike of the striker 18 against the plunger 14 is performed. During this compression phase, in other words during a percussion period, during which the drive motor 10 rotates seven times, the instantaneous motor rotary speed in accordance with the present invention can be changed depending on one or several optimization criteria, by the action of the operating unit 12 on the drive motor 10. With other conversion ratios, the drive motor 10 rotates in a percussion period more or less than seven times. By the variation of the motor rotary speed in the percussion period, the axial speed of the conversion element 30, the piston 24, and correspondingly the speed of the striker 18 is determined depending on their position in the percussion mechanism tube 16.

Figure 5:
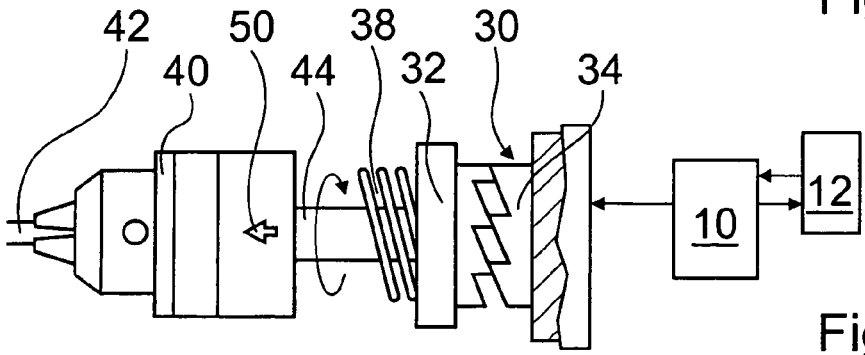
FIG. 5 is a view schematically showing a preferable mechanical percussion mechanism with locking discs in accordance with the present invention.

FIG. 5 shows a mechanical percussion mechanism with a locking disc pair as a conversion element 30. One rotatable locking disc 32 is mounted on a drilling spindle 44, and another fixed locking disc 34 is mounted on a motor housing 36. A tool holder 40 is provided on the tip of the drilling spindle 42 for receiving a tool 42. By turning of the drilling spindle 44 the locking formations of the locking disc 32, 34 slide over one another and the drilling spindle 44 moves forwardly. When the locking formations slide over the locking tips, the locking formations under the action of the pressing springs 34 and the pressure of an operator of the hand power tool, fall due to the transverse flanks of the locking formations back into their initial positions. A transmission between the drive motor 10 and the drilling spindle 44 can be provided.

Here also in accordance with the present invention, within a percussion period the instantaneous motor rotary speed can be changed depending on one or several optimization criteria. When for example the conventional locking discs 32, 34 have 16 locking formations, during a rotation of the locking discs 32, 34 eight impacts are delivered on a drilling surface. In particular by provision of the operating unit 12, in addition to the transmission ratio as described herein above, also the number of the locking formations can be taken into consideration.

With the inventive method, a desired axial movement of a body which is in direct operative connection with the conversion element 30, in particular a piston 24 or a drilling spindle 44, is calculated depending on at least one operational criterium and preferably stored in a storage of the operating unit 12, for example as a characteristic field or the like. The movement of the drive motor 10 can be recalculated from the desired movement and adjustable in correspondence with the calculations. Therefore, for example characteristic line families can be provided, which have different optimization criteria as parameters and deal with actual operational conditions, tool types, tool sizes, and/or materials to be machined, for example wood, brick or concrete.

When the drive motor 10 during a percussion period rotates in correspondence with a transmission ratio of a transmission, the instantaneous motor rotary speed is varied by a motor control or motor regulation of a control unit or regulating unit as a preferable operating unit 12. Preferably the drive motor 10 within the corresponding number of motor revolutions during a percussion period, is controlled electronically so that it achieves the desired movement course within the number of motor revolutions.

It will be understood that each of the elements described above, or two or more together, may also find a useful application in other types of methods and constructions differing from the types described above.

While the invention has been illustrated and described as embodied in hand power tool with a percussion mechanism as well as a method of operating the hand power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A hand power tool, comprising a percussion mechanism; a drive motor that drives said percussion mechanism; a conversion element for converting a movement of said drive motor into an axial movement; and an operating unit that periodically adjusts an instantaneous rotary speed of said conversion element within a percussion period depending on at least one optimization criterium, said optimization criterium being an optimal percussion speed, wherein said operating unit varies a rotary speed of said drive motor so that an axial movement of a body which is in direct operative connection with said conversion element has a path-time course which deviates from a sine form.

2. A hand power tool as defined in claim 1, wherein said drive motor is controllable by said operating unit.

3. A hand power tool as defined in claim 1, wherein said operating unit is capable of adjusting a pressure in a compression chamber of said percussion mechanism.

4. A hand power tool as defined in claim 1, wherein said operating unit is capable of adjusting a drive moment of said drive motor.

5. A hand power tool as defined in claim 1, wherein said conversion element has a crank drive.

6. A hand power tool as defined in claim 1, wherein said conversion element has locking discs.

* * * * *